US006016940A

United States Patent [19]

Florent et al.

[11] Patent Number: 6,016,940

[45] Date of Patent: Jan. 25, 2000

[54] PROCESS FOR CASTING MOLTEN METAL IN A CONDUIT COMPRISING AT LEAST TWO REFRACTORY PARTS

[75] Inventors: Michel Florent, Dunkerque; Francis Lecleire, Looberghe, both of France

[73] Assignee: Sollac, Puteaux, France

[21] Appl. No.: 09/105,012

[22] Filed: Jun. 26, 1998

[30] Foreign Application Priority Data

Jun. 26, 1997 [FR] France ..... 97-07986

[51] Int. Cl.[7] ..... B22D 41/08

[52] U.S. Cl. ..... 222/590; 222/600; 222/603

[58] Field of Search ..... 222/590, 591, 222/603

[56] References Cited

U.S. PATENT DOCUMENTS

| | | | |
|---|---|---|---|
| 4,199,087 | 4/1980 | Golas et al. | 222/603 |
| 4,721,236 | 1/1988 | Muschner | 222/603 |

FOREIGN PATENT DOCUMENTS

| | | |
|---|---|---|
| 0 620 062 | 10/1994 | European Pat. Off. . |
| 2 277 144 | 1/1976 | France . |
| 2 415 507 | 8/1979 | France . |
| 2 529 493 | 1/1984 | France . |
| 2 560 085 | 8/1985 | France . |
| 0 218 855 | 4/1987 | France . |
| 77 06 699 | 6/1977 | Germany . |

*Primary Examiner*—Scott Kastler
*Attorney, Agent, or Firm*—Oblon, Spivak, McClelland, Maier & Neustadt, P.C.

[57] ABSTRACT

A process in which, during the flow of molten metal in a conduit an inert gas and oil are injected at the position of the joint plane between two refractory parts in such a manner as to prevent the introduction of gases from the atmosphere into this conduit at the position of the joint plane. Apparatus. Advantages: plugging of leaks at the position of the joint plane, lower inert gas consumption absence of degradation of the quality of the molten metal by the inert gas.

12 Claims, 1 Drawing Sheet

PROCESS FOR CASTING MOLTEN METAL IN A CONDUIT COMPRISING AT LEAST TWO REFRACTORY PARTS

BACKGROUND OF THE INVENTION

1. Field of the Invention

The invention relates to a process and a device for sealing the joint plane between two joined refractory parts, for example a joint plane in a molten metal flow conduit.

2. Discussion of the Background

In order to cast steel from a ladle into an ingot mold, the steel is tapped at the bottom of the ladle through a flow-control slide valve, then flows into a distributor through a gate-protecting tube; the steel is then tapped at the bottom of the distributor through an internal nozzle, after which it flows through an external nozzle and into the ingot mold.

Along the steel casting line, there are then disposed two Joint planes of joined refractory parts: one joint plane between two refractory plates of the ladle-tapping slide valve and one joint plane between the two internal and external refractory nozzles.

In practice, a ladle-tapping flow-control slide valve is generally provided with two joined refractory plates sliding one over the other in a plane perpendicular to the direction of flow of the molten metal, each perforated by a hole; the flow of steel can be controlled by sliding the plates in order to adjust the covered areas of the two holes Documents FR 2,560,085, FR 2,415,507 and FR 2,529,493, all incorporated herein by reference describe tapping flow-control slide valves:

- in FR 2,560,085, (which corresponds to U.S. Pat. No. 4,721,236) there are formed, close to the joint plane of the refractory plates, cavities in which hydrocarbons (for example: solid pitch, grease, or methane gas) are disposed or injected: these hydrocarbons travel through the pores of the refractory, especially up to the joined surfaces of the plates, and "thus largely prevent the penetration of molten steel between the plates" (sealing effect) "while imparting a lubricating effect, which prevents deterioration due to friction" (page 2, lines 24 to 30).
- in FR 2,415,507, (which corresponds to U.S. Pat. No. 4,199,087) an inert gas (argon) is injected via an annular duct made in the joint plane of refractory parts forming a casting conduit in order to control the casting flow of metal (especially in order to keep the effect of excessive speed at the start of casting under control); the injected gas is located in the casting conduit. FIG. 3 of FR 2,415,507 shows an enlarged view of a tapping flow-control slide valve having a pouring tube and tube support plate which includes refractory parts 34 (tube support plate) and 25 (pouring tube) joined to form a portion of a conduit 54, an elongated passage 74 and groove 71 in the support plate acting as a fluid circulator for the gas, a gas injector 72, a metal shim 76 having an opening 78 and a set screw 70.
- in FR 2,529,493, it is recalled that the refractory plates of these slide valves are generally made of alumina, zirconia or magnesia, generally graphited, and are carefully impregnated with tar under vacuum; it is pointed out that the movement of metal in the casting tube causes air to be sucked between the plates and thus leads to substantial degradation of inclusion cleanliness of the cast metal; there is described a device provided with an annular duct encircling the casting tube at the position of the joint plane between the refractory parts ("zone to be lubricated and protected"); to improve sealing quality and to limit suction of air, "lubricating and protective material" (for example: pitch derived from coal or petroleum distillation) is injected into this annular duct; this material "expands in the space between the plates" (page 4, line 18).

The joined surface of two internal and external refractory nozzles poses the same problems of sealing as the two joined refractory plates of a tapping slide valve; since the external nozzle, of refractory material, must be able to be changed in the course of casting (by means of a nozzle-changing device), this nozzle therefore shares a joint plane or joined surface with the internal nozzle.

If sealing between two joined refractory elements of the molten metal line is not sufficiently assured, the reduced pressure created in the casting conduit by the flow of molten steel causes suction of external gas at the position of the joint planes of the refractory parts of the line.

In order to prevent certain atmospheric gases such as oxygen and nitrogen from penetrating into the molten metal line at these points, an inert gas such as argon is generally injected at the position of the joined surface; the injected gas is therefore located in the molten metal line.

Thus at the position of the joint planes or joined surfaces of successive refractory parts of a molten metal casting line, there is generally provided an annular duct for diffusion of inert gas to encircle the molten metal conduit at that location.

This annular duct is connected to a supply conduit discharging toward the outside of the nozzles; it is connected in turn to means for inert gas injection.

During molten metal casting, a flow of inert gas intended to be sucked at the position of the joint planes of the refractory parts of the said line is therefore maintained in this annular duct, in such a manner that infiltrations of gas from the atmosphere into the molten metal line is prevented at this location.

The inert gas flowrate is even sufficiently high in general that a portion of the inert gas even escapes to the outside of the joint plane, or in other words toward the atmosphere.

The disadvantage of such a process is that it consumes large quantities of inert gas.

Another disadvantage is caused by the inert gas in the molten metal flow: this gas can have detrimental effects on solidification of the metal (especially in the ingot mold), which is harmful to the quality of the metal obtained.

In addition, to improve the sealing of the joint plane and to limit suction of air into the casting tube, a material such as described in FR 2,529,493, incorporated herein by reference, can also be injected into the joint plane.

To achieve such injection, there are then used circulation means made in one of the refractory elements in such a manner as to extend as far as the joint plane or interface between the refractory elements, as well as means for dispatching this material through these circulation means.

The disadvantage of the device described in FR 2,529,493 is that it rapidly becomes obstructed and that, in the case of obstruction of the means for circulating the injected material, the risk again develops that air will be sucked in large quantities into the casting tube.

OBJECTS OF THE INVENTION

The primary object of the invention is to avoid the disadvantages described above.

SUMMARY OF THE INVENTION

To this end, the invention provides a process for casting molten metal through a conduit provided with at least two joined refractory parts in which, during flow of the said molten metal in the said conduit, a gas which is inert toward the molten metal is injected at the position of the joined surfaces (generally referred to herein as a joint plane) between the two said refractory parts in such a manner as to prevent the introduction of gas from the atmosphere into the said conduit at the position of the said joint plane, characterized in that oil is thrust or injected at the position of the said joint plane by means of the said inert gas.

The invention may also include one or more of the following characteristics:

- the cracking or decomposition temperature of the oil is lower than the temperature of the said joint plane at the position where the said inert gas is injected; consequently, the solid residues of cracking or decomposition plug up the said joint plane, thus improving the sealing thereof,
- the oil contains particles of carbon, especially of graphite and/or carbon black; these solid particles reinforce the effect of plugging of the joint plane.
- the oil is injected intermittently in "doses" of predetermined volume; the inert gas thrusts each dose of oil into the joint plane; the risks of obstruction of the gas-injection lines are reduced still further.
- if the gas is injected into an annular duct made around the conduit in the joint plane, the said volume of the oil dose is preferably larger than the volume of the annular duct.
- the injection or thrusting of oil is controlled as a function of the evaluation of the quality of sealing of the said joint plane; it is even possible to stop the injection of oil completely when it appears that a sufficient sealing quality has been achieved and to restart the injection of oil when the sealing quality deteriorates once again; this control makes it possible to maintain the consumption of inert gas at a minimum level and also makes it possible to limit the risks of obstruction.
- the injection of oil is controlled by modifying the frequency of injection of the oil doses.
- the said sealing quality is evaluated as a function of the injection pressure of the inert gas or as a function of the injection flowrate of the inert gas: at given flowrate, a low pressure is indicative of poor sealing; at given pressure, a high flowrate is indicative of poor sealing.

Another object of the invention is a molten metal casting device capable of being used for operation of the process according to the invention, of the type provided with:

- at least two successive and joined refractory parts (34, 25) forming a portion of conduit (54) for the molten metal,
- a fluid circulator (74) made in at least one of the refractory parts (34) to extend as far as the joint plane (76, 78) of the said two refractory parts,
- an inert gas injector (72) adapted to inject inert gas into said circulator,
- the circulator and the gas injector being adapted to prevent introducing gas from the atmosphere into the said conduit at the position of the said joint plane,
- characterized in that it is provided with an oil injector or thrustor (73) for injecting or thrusting the oil into the said gas circulation means.

According to a variant of this device, the circulator comprises an annular duct made around the conduit in the joint plane of the two refractory parts and a supply conduit of the annular duct discharging toward the outside and connected to the gas injector.

The invention will be better understood by reading the description hereinafter, given by way of non-limitative example, and with reference to the case of the junction between two joined refractory nozzles in a continuous steel casting line.

DESCRIPTION OF THE PREFERRED EMBODIMENTS

Figure 1:
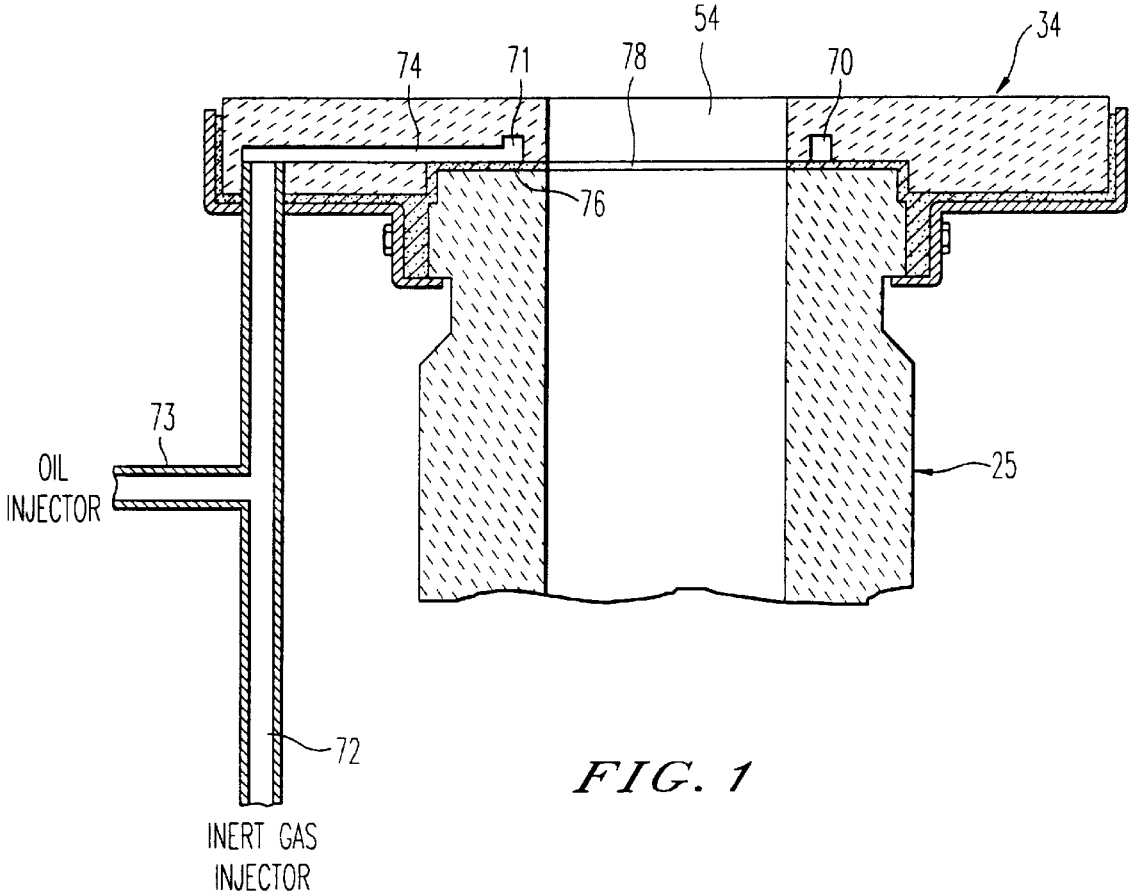
FIG. 1 is a sectional view of a portion of a conduit and flow-control slide valve used in a molten metal casting device.

The preferred steel casting line comprises a ladle, a distributor and an ingot mold: the molten steel of the distributor is tapped via an internal nozzle which is integral with the bottom of the distributor and which communicates with an external refractory nozzle, the lower end of which dips below the molten metal level in the ingot mold.

The two refractory parts comprising the internal nozzle and the external nozzle therefore form a casting conduit element for the molten steel.

The junction plane or joined surface of these two parts is provided with an annular duct encircling the conduit and a supply conduit of the annular duct discharging toward the outside.

The supply conduit is connected to the inert gas injector by any appropriate connector or connection means, known to those of ordinary skill in the art.

A device suitable for injecting oil into the inert gas supply line is added to this line at the position of the annular duct.

This oil injection device can be a continuous injection device or a device for periodic intermittent injections of oil "doses".

As the continuous oil injection device, it is possible in particular to use a device for atomizing oil droplets into the inert gas, or else an "oiler" of the type that is classically installed in compressed air supply lines of pneumatic thrustors known to those of ordinary skill in the art.

The preferred molten metal casting process according to the invention will now be described.

The steel is poured into the distributor in a manner known in itself, the steel contained in the distributor then flows by gravity into the ingot mold through the conduit formed by the two refractory nozzles.

During the flow of molten metal in this conduit, the supply conduit of the annular duct is supplied with an inert gas such as argon in such a way that, if leaks are present in the junction plane of the two nozzles, only inert gas penetrates into the molten metal, and so any risk of contamination of the molten steel by reactive gases such as oxygen or nitrogen from the atmosphere is avoided.

It must be noted that these leaks are a consequence of machining defects in the joint planes of the nozzles and of wear of these joint planes resulting, for example, from positioning of the external nozzle during nozzle changing.

In the case of casting slide valves at the outlet of a ladle, these leaks are a consequence of wear of the two sliding plates of the slide valve.

The inert gas injection flowrate in the joint plane of the nozzles therefore depends on the level of these leaks and is adjusted in a manner known in itself so as to avoid any risk of contamination of the molten steel by reactive gases such as oxygen or nitrogen.

According to the invention, the oil is therefore injected into the inert gas supply line an appropriate device in such a manner as to entrain it into the annular duct and to distribute it uniformly over the entire circumference of this duct, from which it is then sucked or thrust, together with the inert gas, through the leaky interstices all around the joint plane of the two nozzles, on the one hand toward the center of the conduit where the molten metal is flowing, and on the other hand toward the outside of the said conduit.

Since the zone of the joint plane, especially the zone between the annular duct and the internal wall of the conduit, is at very high temperature, the oil entrained into this joint plane decomposes to solid particles which agglomerate and accumulate progressively in the leaky interstices until it completely plugs them.

By virtue of the invention, therefore, improved if not complete sealing of the joint plane is progressively achieved, thus making it possible substantially to diminish the consumption of inert gas: in addition, since the oil injection line is common with the gas injection line, the risks of obstruction encountered in the device described in FR 2,529,493 are considerably decreased, in the case of insufficient plugging of the joint plane, the injection of inert gas always makes it possible to prevent suction of air into the casting tube.

It is observed that sealing is achieved more rapidly when oil doses of volume larger than that of the annular duct are injected, and these oil doses are then injected intermittently.

An improvement in the quality of the steel cast according to the invention is also observed, especially because the quantity of inert gas entrained in the molten metal is much smaller.

The invention is preferably operated by choosing an oil whose cracking or decomposition temperature is lower than the normal temperature prevailing in the annular duct while metal is being cast in the conduit.

The invention is preferably operated by using oils containing suspended carbon particles, in order to facilitate plugging of the leaks.

The invention will be illustrated by the following examples.

EXAMPLE 1

The purpose of this example is to illustrate the process according to the invention applied to plugging of the joint plane between two steel casting nozzles.

The characteristics of the device at the position of the joint plane are as follows:

internal diameter of the steel casting conduit: 70 mm:

diameter of the annulus of the annular inert gas injection conduit: 120 mm:

annular conduit of approximately semicylindrical section: width 5 mm, height 3 mm (the total volume of the annular conduit is therefore approximately 4 $cm^3$);

nature of the inert gas: argon;

nature of the oil used for injection: "TELLUS 22" oil of the SHELL Co.;

The oil injection device is suitable for injecting oil doses of volume very much larger than that of the annular duct intermittently and in such a manner that these oil doses are thrust by the inert gas and become distributed uniformly throughout the volume of the annular duct: an overpressure of inert gas may be necessary for this purpose while an oil dose is being injected.

During the casting of steel in the casting conduit, while inert gas is being injected into the annular duct in a manner known in itself to prevent reactive gases from penetrating into the casting line, oil is therefore also injected into the inert gas line by means of the oil injection device.

Preferably the operation of the oil injection device is automatically controlled in such a manner as to stop the injections as soon as the required sealing quality has been achieved and to resume them as soon as the evaluated sealing quality is no longer considered to be sufficient.

The quality of sealing between the two nozzles is evaluated, for example, by measuring the supply pressure of the annular duct at constant flowrate or, for example, by measuring the supply flowrate under constant pressure.

When leaks toward the outside of the casting conduit exist at the position of the joint plane, the quantity of oil sprayed toward the outside into the atmosphere during injections inflames spontaneously at the position of the joint plane.

The carbon contents of the steel obtained after operation of the invention were analyzed, and no uptake of carbon in this steel was observed, thus clearly indicating that the process according to the invention does not contaminate the molten metal with carbon.

One potential concern had been, in fact, that solid particles resulting from decomposition of the oil would be entrained into the metal during operation of the invention.

EXAMPLE 2

Other conclusive tests were performed under the same conditions as in Example 1 and with the same oil, but loaded:

either with 10% by weight of graphite (particle-size distribution: 70% passing a screen with mesh openings of 100 $\mu$m).

or with "carbon black" of quality normally used in "mold powder", or in other words for lubrication of the steel in continuous casting ingot molds; this powder was provided by the DENAIN ANZIN MINERAUX Co.

EXAMPLE 3

The purpose of this example is to illustrate a variant of the operation of the casting process according to the invention in the case in which oil "doses" are injected periodically into the inert gas supply line, in the case in which inert gas supply means are available that can be flowrate-controlled and in the case in which the injection of oil and of inert gas is controlled as a function of a "target" sealing quality.

According to this variant:

"high" and "low" values of inert gas supply flowrate are fixed: the "low" value can be equal to 10% of the "high" value.

from these values, "floor" and "ceiling" values of supply pressure of the annular duct are determined and fixed:

the volume of each injected "dose", the period of injection of that dose and a maximum number of sealing doses are also fixed; preferably, this volume is much larger than the volume of the annular duct.

the annular duct is supplied with inert gas at an inert gas flowrate established at the said "high" value and, while the metal is being cast, the supply pressure of the said duct is measured;

then, provided the pressure in this duct does not reach the predetermined pressure "ceiling", an oil "dose" is injected during each injection period into the inert gas line in such a manner as to thrust the oil dose into the annular duct and to distribute it uniformly in the volume of this duct: the thrusting of the oil dose may necessitate an instantaneous overpressure of inert gas.

When the measured pressure is low at constant flowrate, this means that the leakage level is high at the position of the joint plane of the nozzles.

When the measured pressure is high at constant flowrate, this means that the leaks have been plugged or almost plugged.

if the pressure in this duct then attains the said pressure "ceiling", the inert gas flowrate supplying the annular duct is reduced to the said "low" value:

if the pressure subsequently falls below the pressure "floor", the inert gas flowrate is increased again to the level of the "high" value;

if the pressure in this duct does not attain the said pressure "ceiling" when the maximum number of oil injection doses has been attained, the oil injections are stopped and the inert gas flowrate is maintained at its "high" level;

The periodic injection of large doses of oil and the uniform application thereof in the entire volume of the annular duct makes it possible to avoid fouling of the annular duct, as is necessary in order to be able to maintain sealing of the joint plane and to restore it if necessary, especially after a change of external nozzle.

If this variant is applied to the installation described in Example 1 or 2, it is possible to choose, for example, the following values:

"high" value of inert gas flowrate: 5 N.1/min (liters per minute at normal temperatures and pressure).

"low" value of inert gas flowrate: 0.5 N.1/min.

"floor" value of supply pressure: $0.2\times10^5$ Pa.

"ceiling" value of supply pressure: $1\times10^5$ Pa.

"nominal" volume of an oil injection dose: 50 $cm^3$.

period of oil injection: 5 minutes.

maximum number of oil injection doses: 5.

During operation of the process according to the invention, it is noted that the argon supply pressure in the supply duct of the annular duct changes progressively from $0.3\times10^5$ Pa to $2\times10$ Pa, indicating good plugging of the joint plane of the two refractory nozzles.

It is observed that the pressure change following oil injections can be spread over several minutes.

The various connectors, injectors, circulators, conduit, thruster, etc. of the invention are known to those of ordinary skill in this art, and their assembly and use according to the disclosure and instructions above is similarly within the level of ordinary skill.

Obviously, numerous modifications and variations of the present invention are possible in light of the above teachings. It is therefore to be understood that within the scope of the appended claims, the invention may be practiced otherwise than as specifically described herein.

French patent application 97 07986 from which this application claims priority, is incorporated herein by reference.

We claim:

1. In a process for casting molten metal through a conduit provided with at least two joined refractory parts in which, during flow of said molten metal in the conduit a gas which is inert toward the molten metal is injected at the position of a joint plane between the two refractory parts in such a manner as to prevent the introduction of gas from the atmosphere into the said conduit at the position of the said joint plane, the improvement wherein oil is thrust or injected into said joint plane towards said molten metal by said inert gas.

2. A process according to claim 1, wherein the cracking or decomposition temperature of the said oil is lower than the temperature of the said joint plane at the position where the inert gas is injected.

3. A process according to claim 1 wherein said oil contains particles of carbon.

4. A process according to claim 1, wherein the oil is injected intermittently in doses.

5. A process according to claim 1, wherein the volume of oil is determined by measuring the injecting pressure of the gas or the injection flowrate of the gas.

6. A process according to claim 4, wherein the volume of oil is determined by measuring the injecting pressure of the gas or the injection flowrate of the gas.

7. A process according to claim 6, wherein the volume of oil injected is a function of the frequency of injection of said doses.

8. A process according to claim 4, wherein the volume of oil injected is a function of the frequency of injection of said doses.

9. A molten metal casting device capable of being used for operation of the process according to claim 1, comprising:

at least two successive and joined refractory parts forming a portion of a conduit for molten metal, a fluid circulator made in at least one of the refractory parts to extend as far as a joint plane of the two refractory parts, an inert gas injector arranged to inject inert gas into said circulator, the circulator and gas injector being adapted to prevent introducing gas from the atmosphere into the said conduit at the position of the said joint plane, wherein said device is provided with an oil injector or thrustor for injecting or thrusting the oil into said circulator.

10. A device according to claim 9, wherein said circulation means comprise an annular duct made around the said conduit in the joint plane of the said two refractory parts and a supply conduit of the said annular duct discharging toward the outside and connected to said gas injector.

11. A process for casting molten metal through a conduit provided with at least two joined refractory parts in which, during flow of said molten metal in the conduit, a gas which is inert toward the molten metal is injected at the position of a joint plane between the two refractory parts in such a manner as to prevent the introduction of gas from the atmosphere into the said conduit at the position of the said joint plane, wherein oil is thrust or injected intermittently in doses into said joint plane towards said molten metal by said gas, and wherein the gas is injected into an annular duct made around said conduit in said joint plane and the volume of the oil dose injected is larger than the volume of said annular duct.

12. A process for casting molten metal through a conduit provided with at least two joined refractory parts in which, during flow of said molten metal in the conduit, a gas which is inert toward the molten metal is injected at the position of a joint plane between the two refractory parts in such a manner as to prevent the introduction of gas from the atmosphere into the said conduit at the position of the said joint plane, wherein oil is thrust or injected intermittently in doses into said joint plane towards said molten metal by said gas, and wherein the gas is injected into an annular duct made around said conduit in said joint plane and the volume of the oil dose injected is larger than the volume of said annular duct and the ingestion or thrusting of oil is determined by measuring the injecting pressure of the gas or the injection flowrate of the gas.

* * * * *